US005123120A

United States Patent [19]

Ross

[11] Patent Number: 5,123,120

[45] Date of Patent: Jun. 23, 1992

[54] PROTECTIVE PANTS

[76] Inventor: Stanley M. Ross, 11059 - 130A Street, Surrey, B.C., Canada, V3T 3P1

[21] Appl. No.: 696,764

[22] Filed: May 7, 1991

[51] Int. Cl.[5] ..... A41D 13/02

[52] U.S. Cl. ..... 2/229; 2/23; 2/79; 2/46; 2/49 R; 2/51; 2/69; 2/82; 2/48; 2/230

[58] Field of Search ..... 2/229, 230, 22, 23, 2/79, 46, 49 R, 51, 82, 69, 48, 235, 236, 237

[56] References Cited

U.S. PATENT DOCUMENTS

| | | | |
|---|---|---|---|
| D. 201,861 | 8/1965 | Cummins | D3/26 |
| 872,089 | 11/1907 | Sommers | 2/230 |
| 965,596 | 7/1910 | Pell | 2/230 |
| 1,829,892 | 11/1931 | Eichengreen | 2/230 |
| 3,085,248 | 4/1963 | Benson | 2/46 |
| 3,517,394 | 6/1970 | Robinson | 2/51 |
| 4,038,698 | 8/1977 | Smith | 2/79 |
| 4,110,845 | 9/1978 | Chellis | 2/62 |
| 4,506,391 | 3/1985 | Rodman | 2/227 |
| 4,638,509 | 1/1987 | Charron | 2/46 |
| 4,651,346 | 3/1987 | Hale | 2/46 |
| 4,697,286 | 10/1987 | Cho | 2/22 |
| 4,716,596 | 1/1988 | Hofman | 2/69 |
| 4,984,303 | 1/1991 | Ross | 2/22 |
| 5,033,124 | 7/1991 | Bucalo et al. | 2/46 |
| 5,033,126 | 7/1991 | Wruck et al. | 2/46 |

*Primary Examiner*—Werner H. Schroeder
*Assistant Examiner*—Gloria Hale
*Attorney, Agent, or Firm*—Shlesinger Arkwright & Garvey

[57] ABSTRACT

A set of protective pants which includes a waist band for attachment around a waist of a wearer, a pair of leg portions affixed to the waist, each having a crotch edge extending from a front of said waist band to a rear thereof. The crotch edges are unconnected to each other so as to provide maximum freedom of movement.

12 Claims, 6 Drawing Sheets

PROTECTIVE PANTS

FIELD

The present invention relates to protective pants designed to fit over the regular clothes of a wearer for protecting a wearer from rain or from contact with soiled objects.

BACKGROUND

Known protective pants which are normally worn over the regular clothes of a wearer to protect a wearer's clothes or the wearer from getting wet or becoming soiled by contact with soiled objects generally restrict free movement of the wearer so as to make activities such as outdoor work, sporting activities and the like more awkward. One solution to providing greater freedom in protective gear is to employ a type of gear called "chaps" which covers only the front of the wearer. Such rain chaps do offer, in fact, greater freedom of movement than do protective pants, but at the expense of reduced protection. For example, with some types of chaps, rain water running down the back of a user falls onto the unprotected back of a user's legs.

Conventional rain pants consist of a pair of pant tubes and a lower torso covering portion integral with the pant tubes with both the pant tubes and the lower torso covering portion being of a waterproof or water resistant material. Some of such pants have an integral bib portion which covers the frontal region of the wearer. Obviously, a bib would not ordinarily be desirable unless it were employed to protect the frontal area of a wearer during the course of a work activity such as loading or unloading a truck. Other types of suits are exemplified by the one-piece rain suit and face mask disclosed in U.S. Pat. No. 4,038,698 issued Aug. 2, 1977 to Leroy Smith.

Known protective gear is directed more to providing improved protection rather than to more freedom of movement.

Accordingly, there is a need for a rain pant design which provides for more freedom of movement than conventional rain pants while at the same time maintaining almost the equivalent protection provided by a conventional set of rain pants.

Accordingly, it is an object of the invention to provide an improved set of protective pants. It is a further object of the invention to provide a set of protective pants which provide greater freedom of movement than conventional protective pants but substantially the same protection. It is a further object of the invention to provide a bib attachable to said pants proximate to a top edge thereof.

SUMMARY OF THE INVENTION

According to the invention there is provided a set of protective pants which includes a waist engaging means for engaging the waist of a wearer and a pair of leg tubes affixed to the waist engaging means, the leg tubes being unconnected to each other such that each leg tube moves relatively independently of the other. A frontal flap is affixed to and depends from the waist engaging means covering a crotch region of a wearer. At the same time as providing greater freedom of movement than conventional protective pants the protective pants herein also provide almost the same amount of protection against rain and the like as do conventional protective pants.

A frontal flap may be affixed to and depend from the waist engaging means to cover a crotch region of a wearer. In fact a pair of overlapping frontal flaps may be affixed to and depend from the waist engaging means with a bottom of said flaps connectable to respective inside regions of the leg tubes below a wearer's crotch.

A pair of overlapping rear flaps may also be affixed to and depend from the waist engaging means with a bottom of the flaps connectable to respective inside regions of the leg tubes below a wearer's crotch.

Advantageously, a bib may be attachable to a frontal portion of the waist engaging means and around a neck of a wearer. The bib may have a frontal portion extending below the waist engaging means and an interior means hidden by a bottom of the frontal portion for removable attachment to the waist engaging means. Having a removable bib is useful as in a great many cases it is preferable to remove the bib when there is no risk of getting wet or soiled in the upper front region of a wearer's body.

The flaps may be tapered downwardly from the waist engaging means. A plurality of apertures may be provided below the waist engaging means to permit air circulation.

The leg tubes may have an open region extending from each side of the waist engaging means downwardly at the rear to a bottom of a crotch region of a wearer and a pair of straps attached to the bottom crotch region and attachable to a rear of the waist engaging region.

Preferably the waist engaging means is a waist band encircling the waist of a wearer.

Preferably the waist band which encircles the waist of a wearer has a detachable belt and means for retaining the pant tubes in a rolled up condition when rolled up towards the waist band. The belt may be detached from the pant tubes along one side thereof and reattached around the waist of a user once the pant tubes have been rolled up.

The retaining means may be a plurality of spaced apart straps attached to the waist band with fastening means on each to permit each to close on itself once it is wound around the pant tubes when the pant tubes are rolled up.

By splitting the pants essentially into two unconnected halves great freedom of movement is obtained in so far as moving the left and right legs independently of one another is concerned. At the same time substantially complete coverage of the body from the waist down is achieved.

The two overlapping flaps hinged to respective leg portions at their ends do not interfere with the freedom of movement achieved by the split halves. At the same time such a structure is capable of providing an overlap which keeps the wearer protected even during movement in which each flap moves with respect to the other in a scissor-like movement. Consequently, it is possible to retain freedom of movement and at the same time provide substantially full pant coverage on both the waist and legs of a user.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
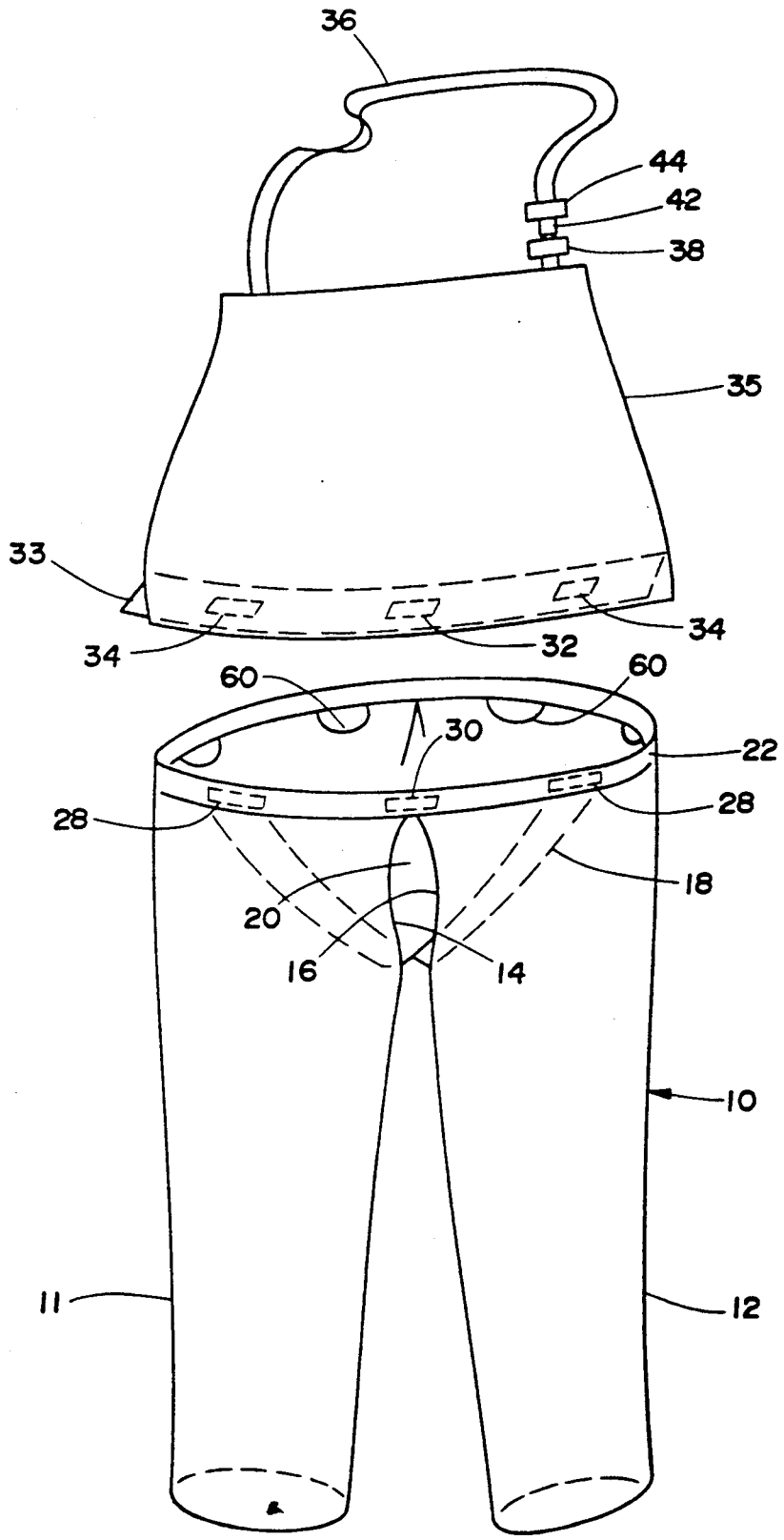
FIG. 1 is a perspective view showing the front of the protective pants and detachable bib.
Figure 2:
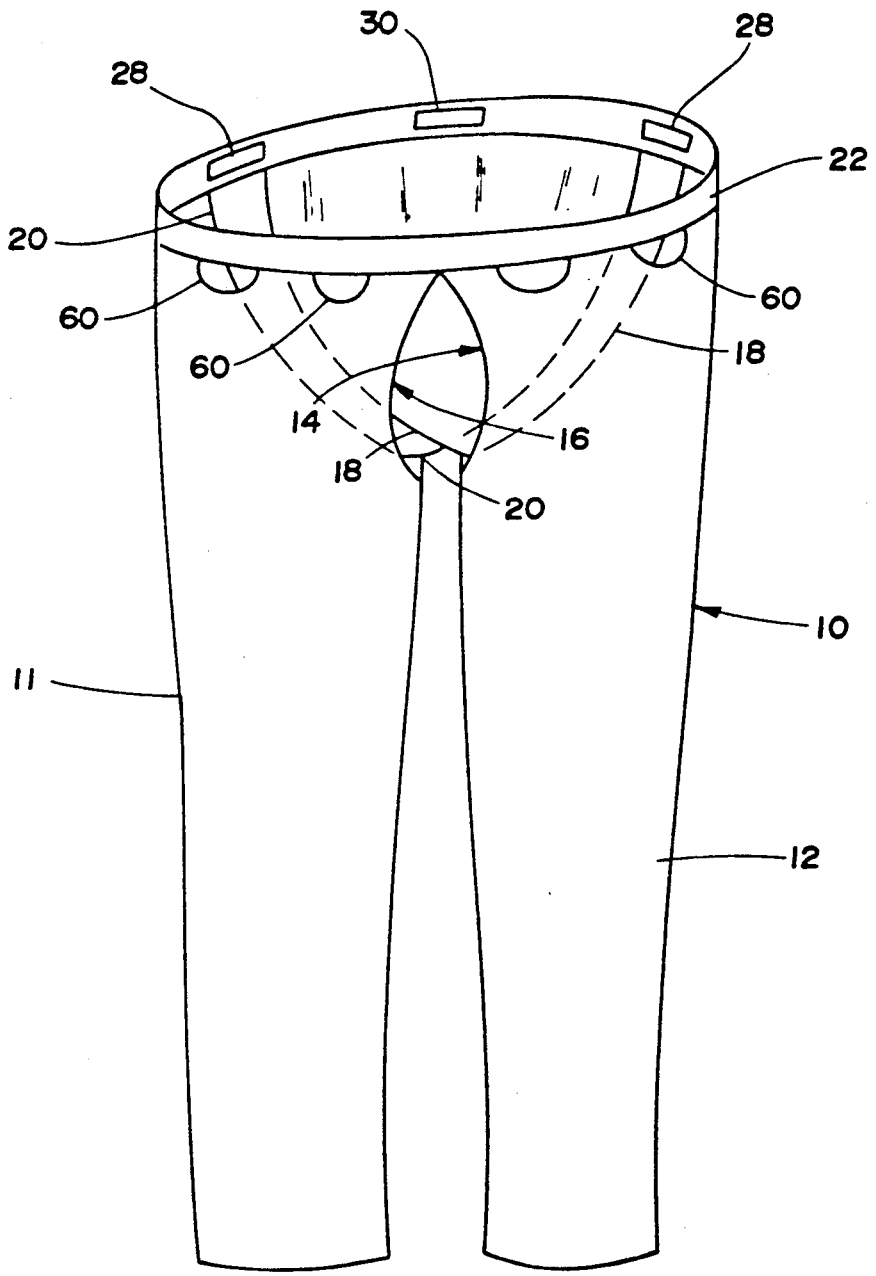
FIG. 2 is a perspective view showing the rear of the protective pants.

Referring to FIGS. 1 and 2, the protective pants 10 are formed by a waist band 22, a part of which is elastic, adapted to fit around the waist of a wearer (not shown) and a left pant portion 11 and right pant portion 12 each attached to the waist band 22. Pant portions 11 and 12 are open around their respective crotch edges 16 and 14 so as to provide complete independence of movement. Tapered flaps 18 and 20 have their long bases overlapping and connected to the front of waist band 22. The tapered end of flap 18 is connected to crotch edge 16 while that of flap 20 is connected to crotch edge 14. The resultant overlapping flaps 18 and 20 provided protection against rain or the like as well as improving appearance.

A plurality of connective pads 28 and 30 of hermaphroditic material such as that sold under the trademark VELCRO are attached around the inside of the waist band 22. Ventilation openings 60 are formed just below the waist band 22 around the back.

Figure 3:
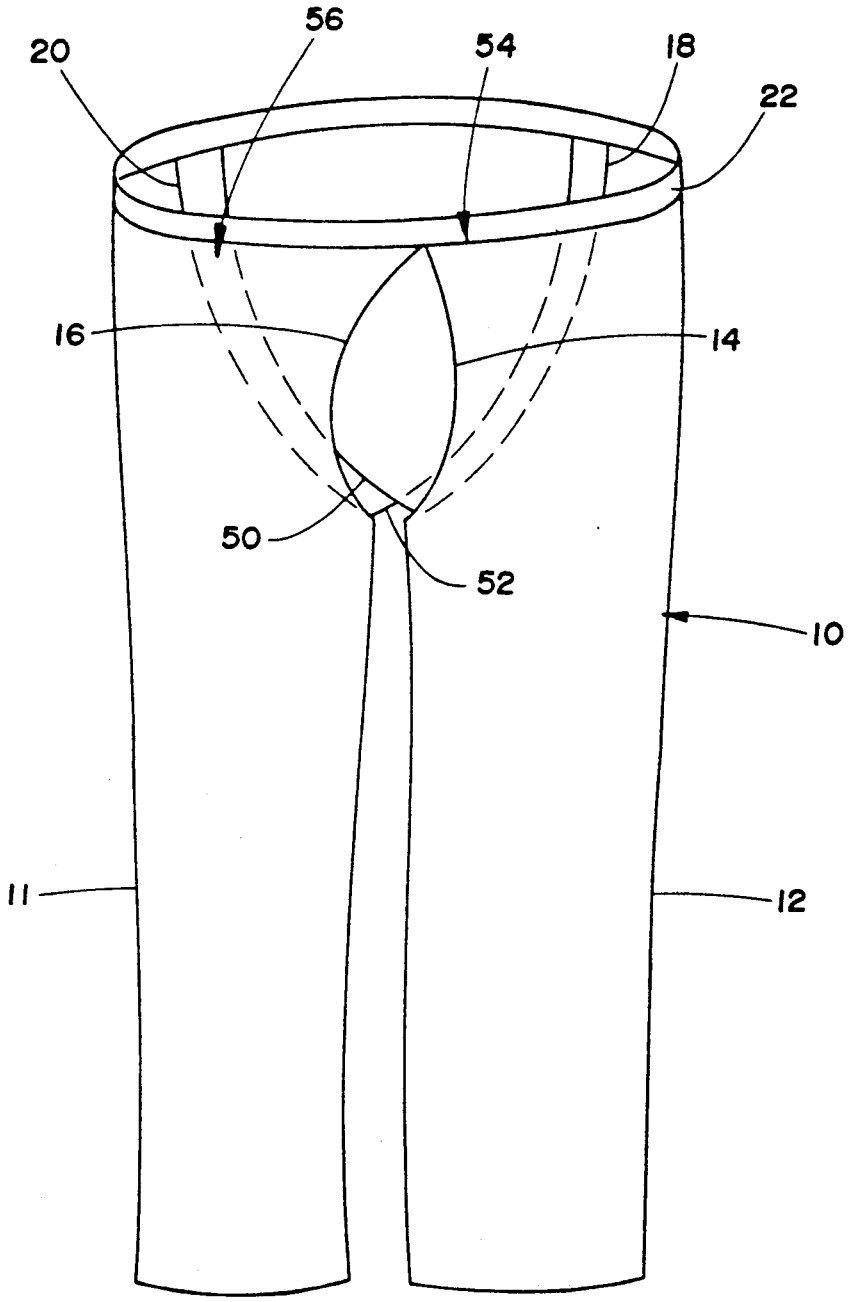
FIG. 3 is a perspective view showing the rear of the protective pants with an extra pair of protective flaps on the back.

A similar set of flaps 50 and 52 may be incorporated at the back as shown in FIG. 3. In this case the elongated bases 54 and 56 of flaps 50 and 52, respectively, connect to the back of waist band 22. The tapered ends of flaps 50 and 52 connect to crotch edges 14 and 16, respectively.

A bib 35, as shown in FIG. 1, having a inside bottom flap 33 with connective pads 32 and 34 positioned on the outer surface thereof away from a wearer facing bib 35, are located so as to overlap and removably connect with pads 28 and 30, respectively. A neck strap 36 is attached at one end to a top corner of bib 35 and has a snap lock 44 with a tongue 42 that inserts into and locks to a corresponding lock piece 38 attached to the other top corner of bib 35. Clearly other forms of attachments are possible.

Figure 4:
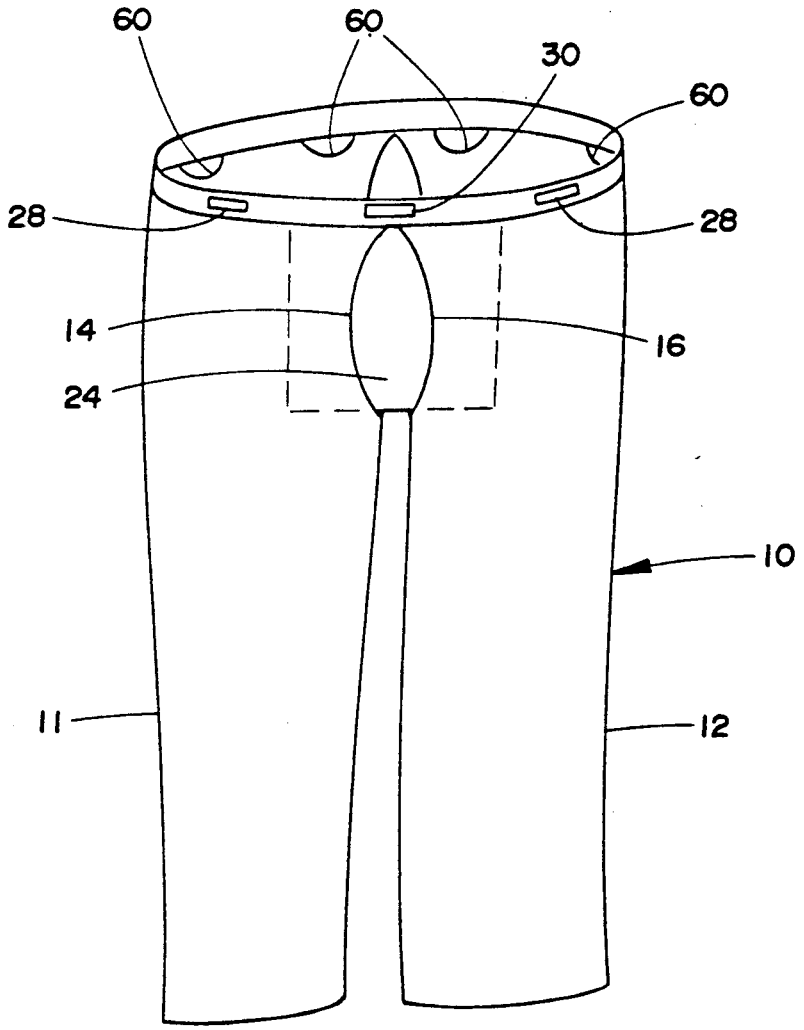
FIG. 4 is a perspective view showing an alternative structure for protecting the front crotch region of a wearer employing a simple flap.

Optionally a single flap 24, as shown in FIG. 4, may be employed which hangs down from the centre with or without being attached at its bottom, other than to the waist band 22, in order to provide protection to a wearer without impeding movement.

Figure 5:
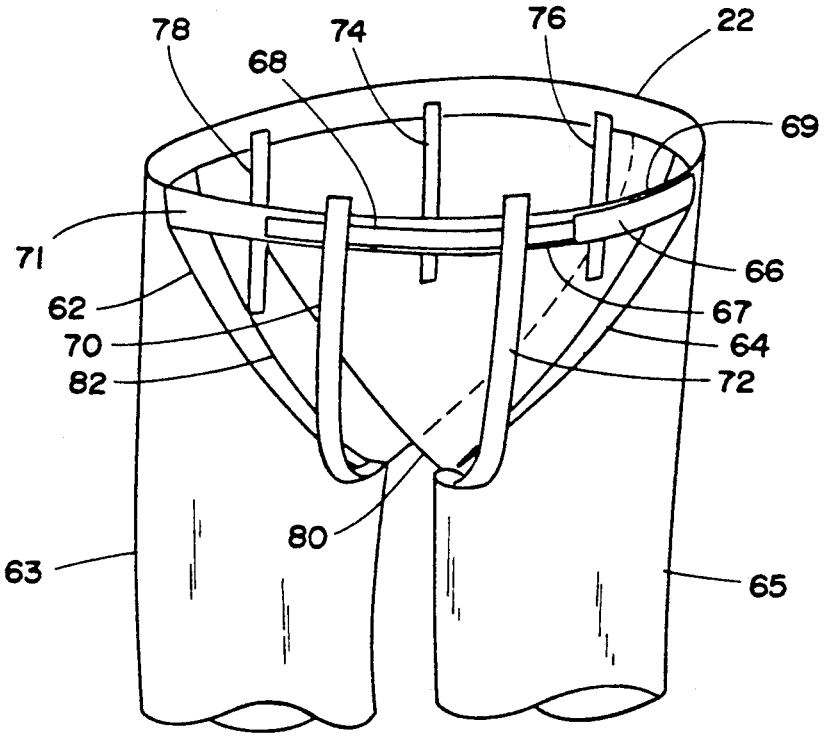
FIG. 5 is a perspective view showing a variant of the pant of FIG. 1 in which the entire rear lower torso portion of the pant is removed and replaced by two detachable straps.

FIG. 5 shows in perspective a top portion of a set of pants with the buttocks covering portion eliminated. In this case edges 62 and 64 define the upper edge of the pant tubes 63 and 65, respectively. Waistband 22 consists of an elastic belt 71 having ends 66 and 69 attached by Velcro 68 on end 69 and mating Velcro (not shown) on end 66. A pair of straps 70 and 72 connect to the inside top edge of the pant tubes 63 and 65, respectively, and are removably attached to belt 71 during use. Three straps 74, 76, and 78 connect to the inside of the front of the waist band 22 and have two spaced apart strips of Velcro thereon to permit the formation of a loop from each strap. Straps 76 and 78 could, however, be replaced by loops.

Figure 6:
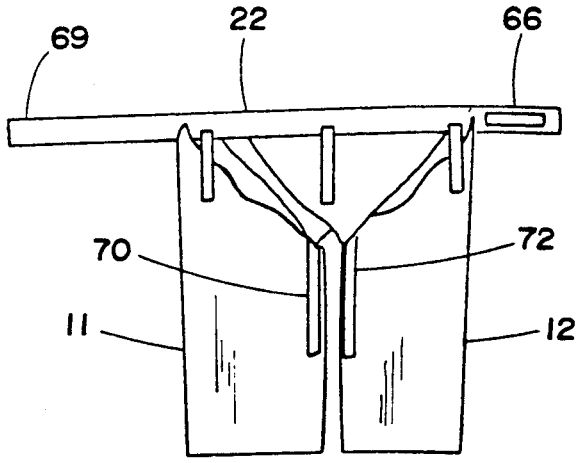
FIG. 6 is a plan view of the pants of FIG. 5 with the belt opened as an intermediate step in rolling up the pants.
Figure 7:
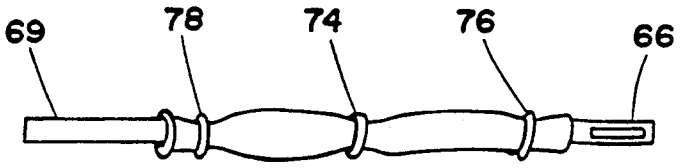
FIG. 7 is a perspective view of the pants of FIGS. 5 and 6 rolled up for attachment around the waist of a user.

Referring to FIGS. 6 and 7 the steps involved in rolling up the pants are shown. First straps 70 and 72 are detached and the pants laid out on a flat surface with the belt detached. Next the pant legs are rolled up and the loops 74, 76 and 78 are attached around the rolled up pants.

Figure 8:
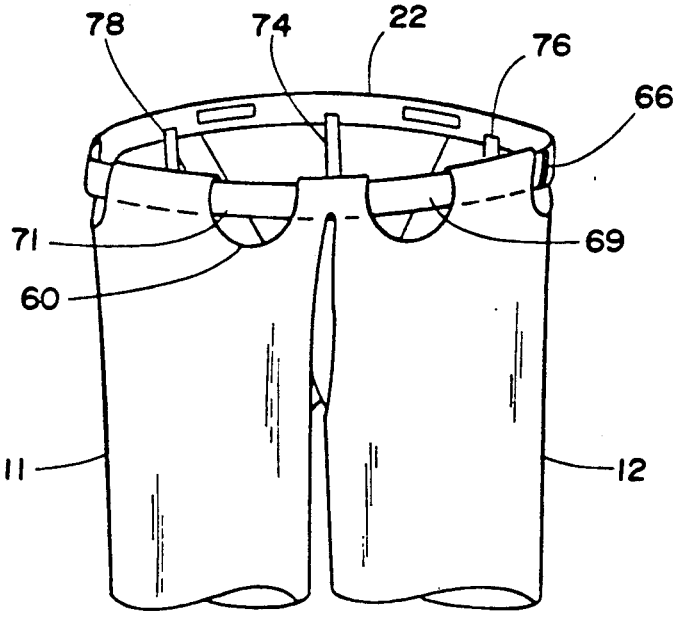
FIG. 8 is a partial perspective view of a rear of a set of pants similar to those of FIG. 1 but having a belt which is detachable.
Figure 9:
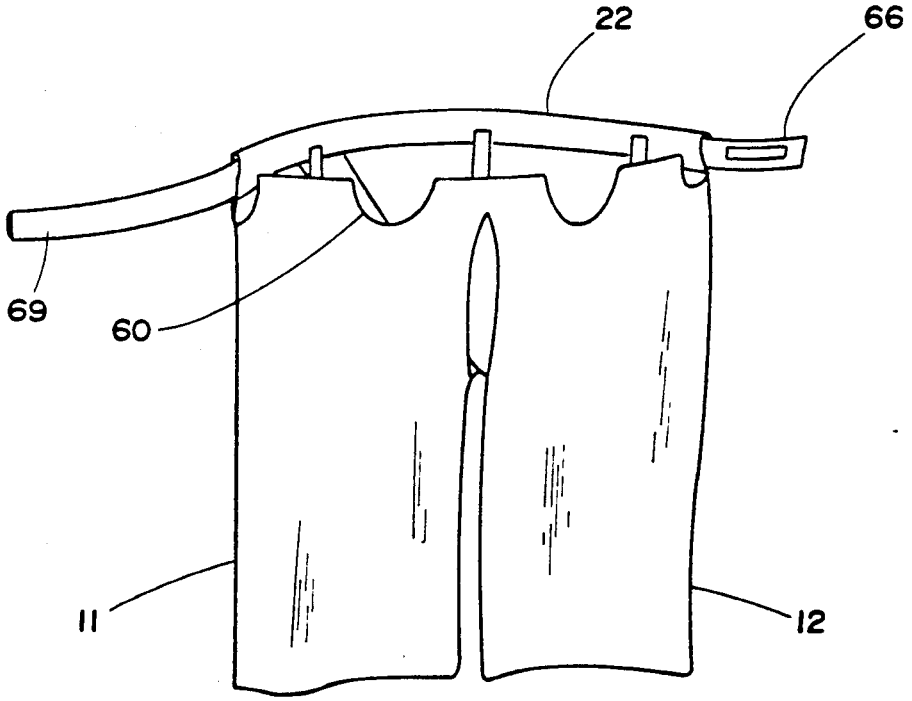
FIG. 9 is a view of the pants of FIG. 8 with the belt opened.

Referring to FIG. 8 and 9 there is shown a pant similar to that of FIG. 1, except with the belt 71 the same as that for the pants of FIGS. 5 to 7. In this case, however, the belt is detached, removed from the waist band at the rear and opened the same as in FIG. 6 after which it is rolled up and connected with loops 74, 76 and 78 as shown in FIG. 7.

Accordingly, while this invention has been described with reference to illustrative embodiments, this description is not intended to be construed in a limiting sense. Various modifications of the illustrative embodiments of the invention will be apparent to persons skilled in the art upon reference to this description. It is therefore contemplated that the appended claims will cover any such modifications or embodiments as fall within the true scope of the invention.

I claim:

1. A set of protective pants, comprising:

(a) a waist engaging means for engaging the waist of a wearer; and (b) a pair of leg tubes affixed to said waist engaging means, said leg tubes being unconnected to each other such that each leg tube moves relatively independently of the other; and (c) a frontal flap affixed to and depending from said waist engaging means down to and covering a crotch region of a wearer.

2. A set of protective pants, comprising:

(a) a waist engaging means for engaging the waist of a wearer;

(b) a pair of leg tubes affixed to said waist engaging means, said leg tubes being unconnected to each other such that each leg tube moves relatively independently of the other; and (c) a pair of overlapping frontal flaps affixed to and depending from said waist engaging means with a bottom of said flaps connectable to respective inside regions of said leg tubes below a wearer's crotch.

3. A set of protective pants according to claim 2, including a pair of overlapping rear flaps affixed to and depending from said waist engaging means with a bottom of said flaps connectable to respective inside regions of said leg tubes below a wearer's crotch.

4. A set of protective pants according to claim 1 or 3, including a bib attachable to a frontal portion of said waist engaging means and around a neck of a wearer.

5. A set of protective pants according to claim 3 or 4, wherein said flaps are tapered downwardly from said waist engaging means.

6. A set of protective pants according to claim 1 or 3, wherein said pants have a plurality of apertures below said waist engaging means to permit air circulation.

7. A set of protective pants according to claim 1, wherein said bib has a frontal portion extending below said waist engaging means and an inside bottom flap means hidden by a bottom of said frontal portion for removable attachment to said waist engaging means.

8. A set of protective pants according to claim 1, wherein said leg tubes have an open region at the rear of a wearer from the waist line around the back and extending to each side of the wearer downwardly to a bottom of a crotch region of a wearer and a pair of straps attached to the bottom crotch region and attachable to a rear of said waist engaging region.

9. A set of protective pants according to claim 1 or 3, wherein said waist engaging means is a waist band encircling the waist of a wearer.

10. A set of protective pants, comprising:

(a) a waist band for encircling the waist of a wearer having a detachable belt; and (b) a pair of leg tubes affixed to said waist band, said leg tubes being unconnected to each other such that each leg tube moves relatively independently of the other;

(c) flap means suspended from said waist band for covering the frontal crotch region of a wearer; and (d) means for retaining said pant tubes in a rolled up condition when rolled up towards said waist band;

wherein said belt can be detached from said waist band along one side thereof and reattached around the waist of a user once the pant tubes have been rolled up.

11. A set of protective pants according to claim 10, wherein said retaining means is a plurality of spaced apart straps attached to said waist band with fastening means on each to permit each to fasten to itself so as to form a loop engaging said pant tubes when said pant tubes are rolled up.

12. A set of protective pants according to claim 10, including a pair of overlapping frontal flaps affixed to and depending from said waist band with bottom ends thereof attached to inside top edge regions of respective pant tubes.

* * * * *